United States Patent [19]

Wolf et al.

[11] Patent Number: 5,034,101

[45] Date of Patent: Jul. 23, 1991

[54] HEADBOX WITH SUPPORT BEAM ON MOVABLE DUCT WALL

[75] Inventors: Robert Wolf, Herbrechtingen; Gernot Kinzler, Heidenheim-Mergelstetten; Simon Juhas, Nattheim, all of Fed. Rep. of Germany

[73] Assignee: J. M. Voith GmbH, Fed. Rep. of Germany

[21] Appl. No.: 424,669

[22] Filed: Oct. 20, 1989

[30] Foreign Application Priority Data

Aug. 19, 1989 [DE] Fed. Rep. of Germany ..... 3927401

[51] Int. Cl.[5] ..... D21F 1/02

[52] U.S. Cl. ..... 162/336; 162/347; 162/344

[58] Field of Search ..... 162/336, 347, 344, 340, 162/339

[56] References Cited

U.S. PATENT DOCUMENTS

| | | | |
|---|---|---|---|
| 4,406,740 | 9/1983 | Brieu | 162/347 |
| 4,551,204 | 11/1985 | Holik et al. | 162/336 |
| 4,770,745 | 9/1988 | Hildebrand et al. | 162/336 |
| 4,783,241 | 11/1988 | Egelhof et al. | 162/347 |

FOREIGN PATENT DOCUMENTS

| | | | |
|---|---|---|---|
| 2199054 | 6/1988 | United Kingdom | 162/336 |

*Primary Examiner*—Karen M. Hastings

*Attorney, Agent, or Firm*—Ostrolenk, Faber, Gerb & Soffen

[57] ABSTRACT

The headbox for a paper making machine includes an outlet duct extending across the machine width. The outlet duct is defined by a fixed duct wall below and by a movable duct wall above which are oriented to converge and define an outlet slot. The movable duct wall is movable by a lifting appliance to adjust the space between the duct walls and also the pressure on the stock suspension passing the outlet slot. The movable duct wall has a duct wall beam disposed on it. A support beam for the movable duct wall extends across the machine. Between the duct wall beam and the support beam is a pressure cushion which acts against the pressure in the outlet duct. The lifting appliance is pivoted on the rigid headbox housing and on the support beam. The lifting appliance meets the movable duct wall beam at its axial end to avoid bending moments on that wall. Alternatively, the lifting appliance meets the support beam axially outward of the axial ends of the movable duct wall and a flexible connection between the movable duct wall and the appliance avoids bending moments on the movable duct wall.

27 Claims, 4 Drawing Sheets

13''
29
29a
28
13
13'
II
S
24
41
42
31
43
43
33
33a
32
19
39
16
11
18
17
27
38
25
4
26'
26
23
7
M
22
8
9

HEADBOX WITH SUPPORT BEAM ON MOVABLE DUCT WALL

BACKGROUND OF THE INVENTION

The present invention relates to a headbox for a machine for the manufacture of fibrous webs made from stock suspensions, and more particularly for the manufacture of paper webs. The headbox is of the type having an outlet duct. The duct has lateral side walls which define a determined duct width The duct is further bordered by two duct walls, respectively located above and below, and converging in the direction of flow of suspension to form an outlet slot in the downstream region. One duct wall is movably and adjustably supported by a duct wall beam, and is preferably pivotally supported at its upstream end, so that the clear width of the outlet slot can be varied by means of a lifting appliance. The bearing force of that appliance acts against the pressure of the suspension which acts on the movable duct wall. A support beam extends across the width of the machine adjacent to the adjustable duct wall beam. The movable duct wall beam together with the support beam extends over the machine width and forms a beam unit. A pressure cushion, which acts against the suspension pressure that acts on the movable duct wall, is disposed between the movable duct wall beam and the support beam.

A headbox of this type is known from German Published Application 3,614,302, which corresponds to U.S Pat. No. 4,770,745. In this publication, the movable duct wall is part of a U-shaped, L-shaped or box-shaped duct wall beam. The support beam, which is different from the duct wall beam, may have an I-shaped or a triangular shaped cross section. In all cases, there is a pivotable connection between the duct wall beam and the support beam located at both ends of the duct wall beam This is known from an advertisement entitled, "Unsere Stufendiffusor-Stoff-Aufläufe sind Marketführer" of Sulzer Escher Wyss, published in the November 1987 issue of "Wochenblatt for Papierfabrikation".

This German application also discloses that the structural unit, which consists of the duct wall beam and the support beam and is hereinafter known as the "beam unit", is connected to the headbox housing by means of a pivot bearing. At each end of the beam unit there is also a lifting appliance, e.g. a spindle, by means of which the movable duct wall can be swung up or down, to vary the clear width of the outlet slot. For this purpose, the movable duct wall is connected to the headbox housing by means of a hinge joint. The publication provides no guidance about how the lifting appliance is hingedly connected to the beam unit However, it is customary to provide a journal hinge at each end of the duct wall beam. See FIG. 4 herein.

A major problem with such headboxes is keeping the clear width, i.e. the space between the top and bottom duct walls, of the outlet slot constant with the greatest possible accuracy over the entire machine width. In practice, it has repeatedly been shown that local deviations in the desired outlet slot width impair the quality of the resulting paper web. Investigations have shown that a W-shaped or M-shaped profile of the cross section of the outlet slot is usually found, which produces a corresponding irregular "weight per unit area transverse cross section" (usually called "cross direction profile of the basis weight") of the paper web. It has also been shown that a certain error in the slot width of the outlet slot can cause a ten fold error in the basis weight of the paper web.

It has also been recognized that some of the problems were caused by the above mentioned articulation of the two lifting appliances located at the two ends of the duct wall beam, i.e. on the front side and the drive side of the paper making machine, by means of a journal hinge Previously, at each end of the movable duct wall itself, a journal extended at right angles to the machine direction and was hinged to the lifting appliance. A large portion of the forces originating from the pressure of the suspension from the movable duct wall must be transferred by the respective journal located on the movable duct wall to the stationary headbox housing. As a result, the journal transmits transverse force and a bending moment into the movable duct wall This has disadvantageous effects on the contours of the movable duct wall for the following reason. The loading of the movable duct wall which originates from the stock suspension is distributed substantially uniformly over the length of the wall, i.e. over the machine width. However, from the opposite direction, the loading of the movable duct wall is composed of a uniformly distributed load produced by the compressed air cushion and by the transverse forces and the bending moments produced by the lifting device. It has been shown that satisfactory results were not achieved under these conditions.

The same comment also applies for the headbox disclosed in Voith (the assignee hereof) publication p. 2503, page 4. For the reasons stated, repeated attempts have been made to improve the uniformity of the outlet slot width by additional measures. More particularly, at the outlet slot, a locally deformable component, e.g. a profile bar, was provided. This could be adjusted by means of a plurality of spindles uniformly distributed over the machine width However, the accuracy which can be achieved by this measure is frequently not sufficient to meet current requirements for paper quality.

SUMMARY OF THE INVENTION

It is an object of the present invention to improve the above headbox so that the clear width of the outlet slot can be kept constant with greater accuracy than before over the machine width.

The headbox of the invention has first and second duct walls, with the first duct wall being relatively movable toward and away from the second duct wall for defining the clear width of the outlet slot. The first movable duct wall as before has the support beam attached to it, and preferably also a box-shaped duct wall beam Those elements are forming together a so-called beam unit which has opposite axial ends. A lifting appliance acts on those opposite axial ends of the beam unit, in such a manner that the bearing force of the lifting appliance is transmitted into the movable duct wall substantially free from bending moments.

For this purpose, in each end region of the movable duct wall, there is a flexible connection between the movable duct wall and the supporting beam Thus, when the lifting appliance applies force to the support beam, which is likely to apply bending moment to that beam, the bending, if any, of the support beam can be absorbed by that flexible connection and the movable duct wall experiences no bending moment.

The invention ensures that no bending moment is transmitted into the movable duct wall either by the lifting appliance or by the connection between the movable duct wall beam and the support beam. The duct wall may preferably be part of a duct wall beam, as before. In this case, the entire duct wall beam remains unstressed by bending moments and shearing forces.

With the invention, the movable duct wall or the entire duct wall beam respectively is only stressed by linear loads, namely on one side by the pressure of the suspension and on the other side by the pressure of the pressure cushion and by its net weight. In addition, in many cases, there is also a reaction force which acts from the hinge joint onto the movable duct wall and which is also a linear load. In all cases, it is possible to keep the clear width of the outlet slot constant almost without exception over the machine width by controlling the pressure prevailing in the pressure cushion. To achieve this goal, it is necessary, inter alia, as mentioned above, to provide flexible connecting pieces instead of a rigid connection between the movable duct wall and the support beam. This feature is known per se from U.S. Pat. No. 3,769,154. This ensures that no bending moments are transmitted into the movable duct wall by an inclination of the ends of the support beam, which is caused by a deflection of the support beam.

It is obvious that with the headbox of the invention, a locally deformable component, e.g. a profile bar, can also be provided at the outlet slot. However, in this case the deformations, e.g. of the profile bar, that are required to correct the clear width of the outlet slot, are substantially smaller than before.

The transmission of the bearing force of the lifting appliance into the movable duct wall in a manner substantially free from bending moments may be achieved in various ways In a first proposal, at each end of the movable duct wall, the lifting appliance, as before, acts directly upon the movable duct wall beam. However, when seen in front elevation onto the headbox, the working line or axis, that is the resultant of force applied by the lifting appliance is preferably disposed so that the working line extends at least approximately through the end point of the duct width. In other words, the distance between the working lines of the two sides of the lifting appliance is determined by the front side and the drive side of the headbox and is at least approximately equal to the duct width.

In another more easily implementable proposal, at each end of the movable duct wall, the lifting appliance does not act upon the movable duct wall or upon the duct wall beam, but only upon the support beam. As a result, it is possible to dispose the working lines of the lifting appliance slightly outside the duct width and, as before, to provide at each end of the beam unit, consisting of the duct wall beam and the support beam, a journal joint for the lifting appliance. However, the individual journal is not disposed on the duct wall or on the duct wall beam but on the support beam. Furthermore, as only a flexible connection is provided between the duct wall beam and the support beam at each end of the beam unit, as already mentioned, the bending moment produced by the journal joint is only transmitted to the support beam, where it is harmless, and not into the movable duct wall.

In a refinement of the invention, the distance between the flexible connection pieces measured from the front side to the drive side of the headbox is also made equal to the duct width.

The result of the present invention, which has already been described, namely the constant clear width of the outlet slot over the machine width, which is at least almost defect-free, can only be achieved if the movable duct beam is not subject to curvature by any differences in temperature. Sometimes it can be observed that certain changes in the width of the outlet slot occur during the operation of the paper making machine and then it is usual for just some of them to disappear. Such modifications in the slot width may be caused by temperature changes in the paper making machine or in the environment. Temperature changes in the paper making machine occur particularly if the production cycle is interrupted, because in this case the various machine parts and the stock suspension have different temperatures. The temperature of the stock suspension normally lies between 30° C. and 60° C., or above, depending upon the paper grade. In operation, the interior of the movable duct wall normally adapts to this stock temperature, while the exterior of the movable wall and the duct wall beam may be subject to a different ambient temperature. Consequently, thermal stresses may be produced which, in turn, cause the changes in the width of the outlet slot.

This problem can be solved by providing tempering ducts in the duct wall beam, through which a tempering fluid flows during operation so that the duct wall beam is kept isothermal. This means that the entire beam over its entire length uniformly over its cross section is kept at the same temperature, which is preferably equal to the temperature of the suspension. The tempering ducts are known from aforementioned German Application 3,614,302.

A further advantageous refinement of the invention specifies that the duct wall beam which extends across the width of the machine is box shaped, i.e. it preferably has a rectangular cross section, and that an additional pressure cushion to act in the opposite direction is provided These features are known from aforementioned German application 3,614,302. However, in contrast to the German application, the support beam of the invention is disposed not inside of but outside the duct wall beam. This feature is known from above noted Voith Publication p. 2503, page 4. It is possible for an additional pressure cushion, which acts in the opposite direction, to be provided despite the aforementioned arrangement of the support beam outside the duct wall beam Such a cushion is advantageous for exerting a force that counteracts the specific gravity on the duct wall beam, for example. This is advantageous so that it is possible to adjust the duct wall beam without bending when the paper making machine is inoperative, as long as no stock suspension is flowing through the headbox, or to keep the beam free from deflections during operation at low operating speed and consequently low suspension pressure.

According to a further important concept of the invention, the duct wall or the entire duct wall beam is at least almost free from torsional moments in the operational position. Such a torsional moment could be produced if, as seen in a lateral view of the headbox, the resultant forces produced from the pressure of the suspension and the bearing pressure of the lifting appliance do not lie along the same working lines. There are two different ways of avoiding such torsional moments. In one technique, the axis of the lifting appliance passes substantially through the center of the movable duct wall, as measured from the free downstream end thereof to the pivoted upstream end. In the other technique, the axis of the lifting appliance passes substantially along the central plane of the beam unit.

Other objects and features of the present invention are described below with reference to the drawings.

DESCRIPTION OF THE PREFERRED EMBODIMENT

Figure 1:
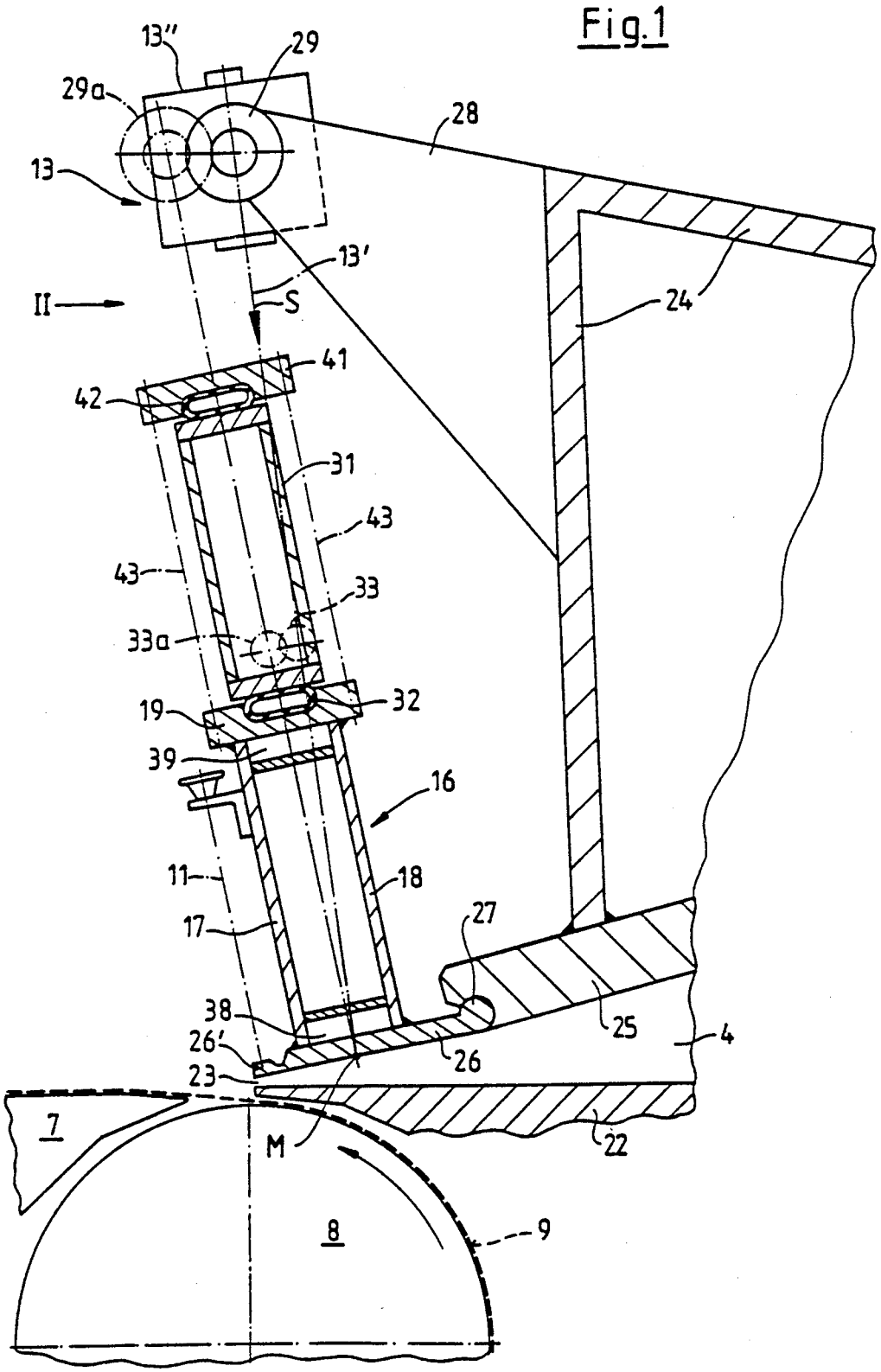
FIG. 1 shows a partial longitudinal section through a first embodiment of a headbox.

The headbox represented is used as known to supply a paper-making-machine-wide flow of stock suspension to the endless wire belt 9 of a paper making machine. The wire belt 9 passes, inter alia, over a breast roll 8 disposed at the headbox and then over a forming board 7. To form the stream of stock suspension, the headbox has a nozzle-like outlet duct 4 or slice, which is limited by a lower relatively stationary duct wall 22 and by an upper relatively movable, adjustable duct wall 25, 26. The upstream part 25 of the upper duct wall is also stationary because it is a component of the fixed headbox housing 24. The downstream part 26 of the upper duct wall is movable up and down in the Figures, so that the clear width of the outlet slot 23 can be varied. This mobility is preferably achieved through the downstream part 26 of the wall being attached to the upstream part 25 at a hinge joint 27. The "length" of the outlet slot 23, i.e. the so called axial duct width between side walls 49, is designated by KB in FIG. 2.

For reinforcing the movable or adjustable duct wall part 26, a so called duct wall beam 16 is placed over that wall part and is rigidly attached to it, e.g. by welding. The duct wall beam 16 is preferably box shaped It has a front or downstream wall 17, a rear wall 18 and an upper wall 19.

Figure 3:
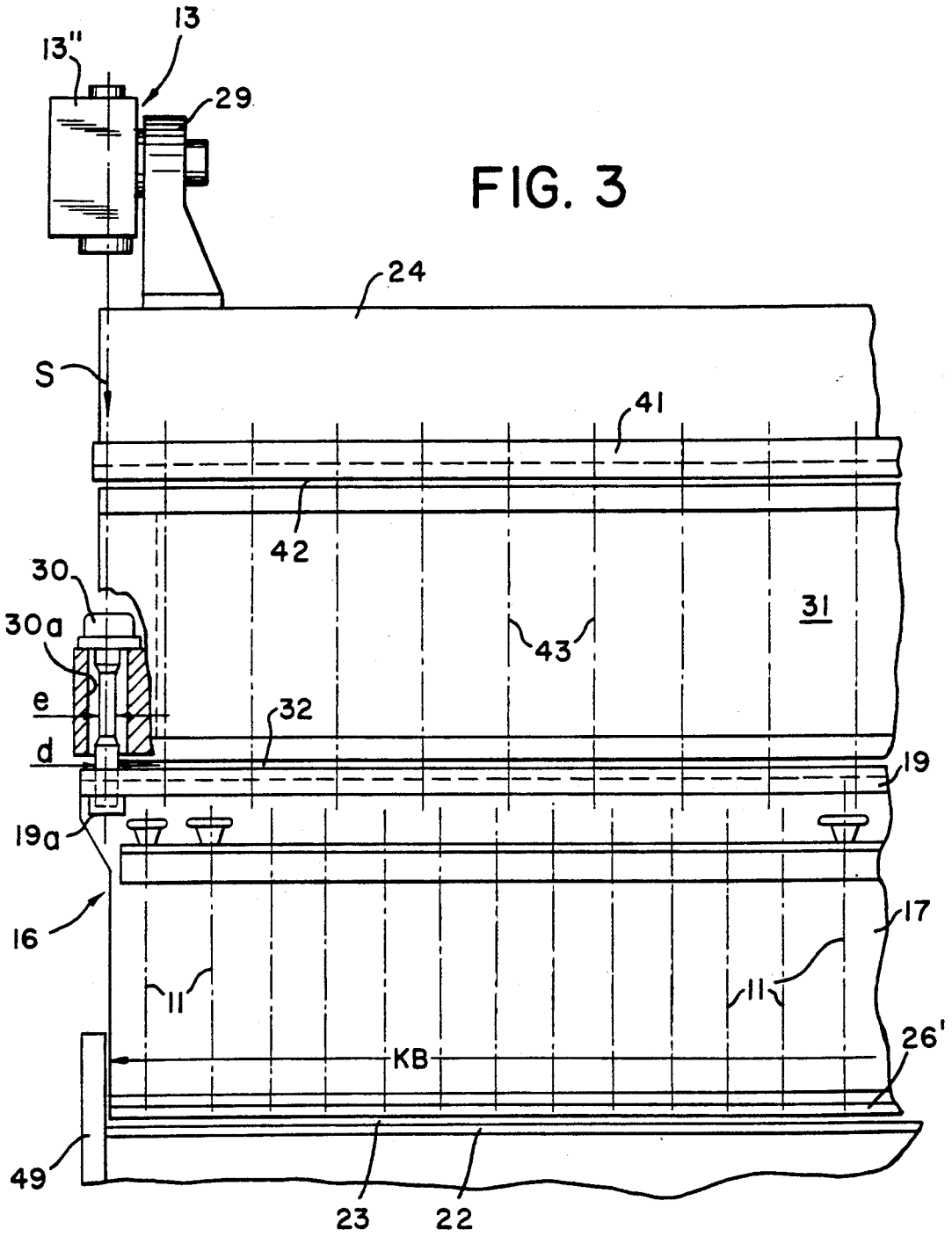
FIG. 3 shows a front elevation like that in FIG. 2, but of a second embodiment of a headbox.

Above the duct wall beam 16, there is disposed a support beam 31, which is also box shaped. Both beams 16 and 31 extend over the entire machine width. They are only connected to each other at their two axial ends, e.g. on the front side and on the drive side of the paper making machine, by flexible connecting pieces, e.g. screws 30. FIG. 3 shows why that connection at 30 is flexible. The screw is smaller than its bore 30*a*. Other freely pivotable arrangements can be selected Duct wall beam 16 and support beam 31 together form a so-called beam unit, in which they are commonly moved together around the axis (hinge joint) 27.

Support beam 31 has a journal 33 at both ends, to which a lifting appliance 13 is connected. The lifting appliance 13 includes a spindle 13' and a gear 13'', which is pivoted in a bearing bracket 28 having bearing 29 attached to the housing 24 The bearing force exerted by the spindle 13' on the beam unit is along the working line or axis and along the direction designated by S.

Between the duct wall beam 16 and the support beam 31 is disposed a pressure cushion 32. That cushion, for example, is in the form of a hose which can be loaded by hydraulic fluid. The pressure prevailing in the pressure cushion 32 can be changed by control devices, not shown. This pressure can be controlled by control devices connected with sensors which take into consideration the fluid pressure prevailing in outlet duct 4 and which take into consideration the net weight of the movable duct wall 26 and the duct wall beam 16. See, for example copending U.S. application No. 07/424,670, now U.S. Pat. No. 4,980,026 filed the same date as this application, entitled Headbox With Movable Duct Wall and assigned to the assignee hereof. As a result, the movable duct wall 26 is totally unaffected by deflection. At the same time, the support beam 31 is deflected slightly upward. In this case, it is expedient to control the fluid pressure as a function of the continuous measurement of the deflection of the duct wall beam 16, as already known.

In order to prevent thermal deformations of the movable duct wall 26, tempering ducts 38 and 39 are provided inside the duct wall beam. The lower tempering duct 38 is provided directly on the upper side of the movable duct wall 26 The upper tempering duct 39 extends along the under side of the upper wall 19. Lines and temperature control devices, not shown, ensure that fluid of substantially equal temperature flows through both ducts 38 and 39. As a result, the duct wall beam 16, including the movable duct wall 26, can be kept isothermal.

In principle, it would be possible to achieve the object of the invention even if the support beam 31 were not disposed on the upper wall 19 of duct wall beam 16, but were inside the duct wall beam, as also known. However, the construction shown is preferred, despite requiring a lot of space, because, among other things, it is easier to carry out maintenance work. If it is required, it is possible to apply a force to counteract the net weight of the duct wall beam 16 on the duct wall beam.

A second beam 41 extending over the entire machine width is disposed above support beam 31. The beam 41 is rigidly connected to the duct wall beam 16 independently from the support beam 31 by means of a plurality of tension members 43, shown symbolically. An additional pressure cushion 42 is provided between the beam 41 and support beam 31. The additional pressure cushion 42 may be loaded at least at times with an adjustable fluid pressure.

It is diagrammatically shown that the outermost or downstream end 26' of the movable duct wall 26 is locally deformable, as known, by means of a plurality of individually operated spindles 11. Consequently, small local corrections to the clear width of the outlet slot can be made.

Figure 2:
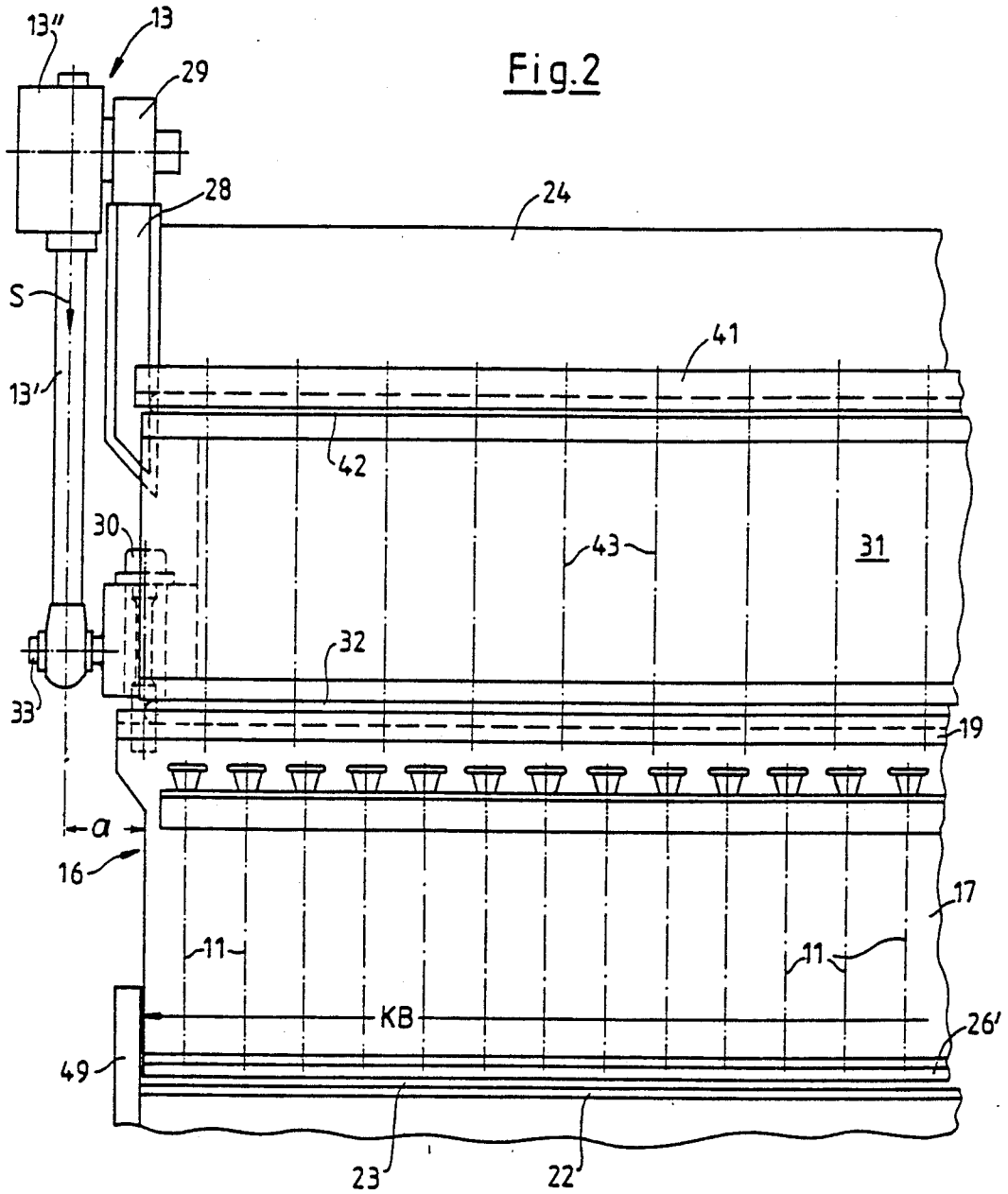
FIG. 2 shows a front elevation in the direction of arrow II in FIG. 1.

In FIGS. 1 and 2, the swivel bearing 29 and the journal 33 are disposed so that the working line of the bearing force S, in the normal operating position of the duct wall 26, passes substantially through its center M, in which the resultant force from the pressure of the suspension acts on the duct wall 26. Consequently, it is possible to avoid a torsional moment acting on the duct wall beam 16. If the resultant force and the bearing pressure S are to counterbalance each other completely, the swivel bearing and the journal are arranged in the position designated by 29*a* and 33*a*, i.e. in the central plane of the beam unit 16, 31, relative to its operating position.

Note that the working line of the bearing force S in FIG. 2 is outward of the duct width (inside of the side walls 49) by a distance, which would produce a bending moment on support beam 31. But the flexible connection at 30 prevents that bending moment from passing into the duct wall beam which beam only receives linear force, not bending, from the cushion 32.

In the alternate embodiment of FIG. 3, the lifting appliance 13 is connected directly to the duct wall beam 19 at a boss 19*a*. In contrast to FIG. 2, the working line of the bearing force S is placed right at the duct width KB between the side walls 49, producing a zero length lever arm and causing no bending moment FIG. 3 shows that the flexible connection at 30 again permits only linear forces upon the duct wall beam, and no bending forces. This is due to the fact that screw 30 has a reduced shaft diameter e (e being smaller than screw diameter d) and that the diameter of bore 30*a* is substantially bigger than screw diameter d.

Figure 4:
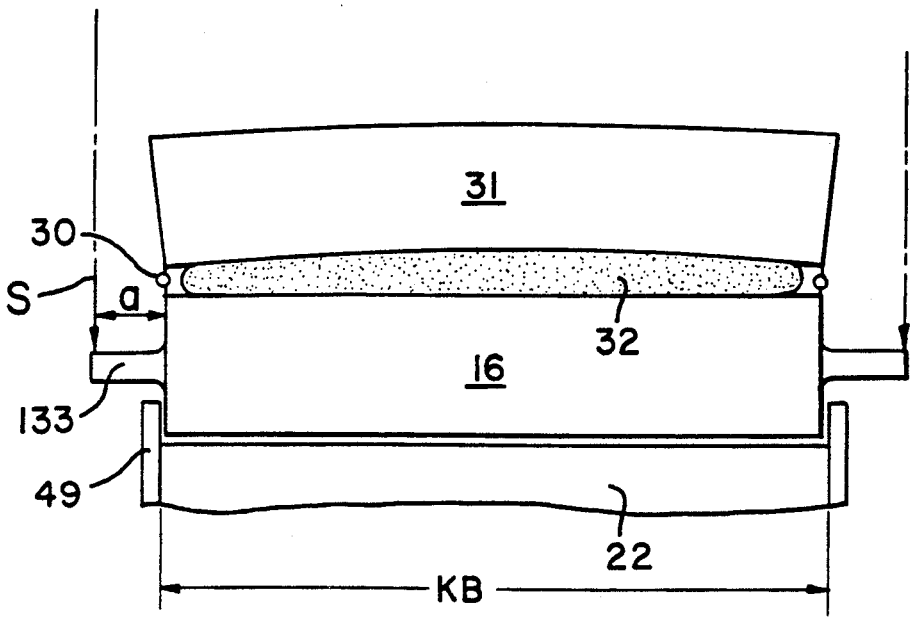
FIG. 4 PRIOR ART.
FIG. 4 is a schematic front elevation of a prior art headbox over which the invention is an improvement.

The prior art is shown schematically in FIG. 4 comprising movable duct wall beam 16, stationary duct wall 22, side walls 49, support beam 31, cushion 32, flexible connections 30. In contrast to FIG. 2, journals 133 are provided at duct wall beam 16. Therefore, the bending moment from force S and lever arm a is transmitted directly to the duct wall beam 16, with the flexible connections 30 being not able to avoid that.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for a machine for the manufacture of fibrous webs from stock suspension, the headbox comprising:

means in the headbox for holding stock suspension; an outlet duct from the headbox, the outlet duct comprising first and second spaced apart duct walls oriented to extend across the width of the machine and across the direction of suspension flow to form, between the walls, an outlet slot from the headbox at the ends of the walls downstream in the direction of suspension flow; means defining a cross-machine width of the duct;

the first duct wall being supported to the headbox for being movable for varying the clear width between the walls of the outlet slot at the downstream ends of the walls through movement of the first duct wall toward and away from the second wall at the downstream ends of the walls;

a lifting appliance for moving the first duct wall for adjusting the clear width of the outlet slot, and the force of the lifting appliance acting against the pressure of the suspension acting on the first duct wall;

a support beam and a duct wall beam extending across the machine width and secured to the first movable duct wall for forming a beam unit;

a pressure cushion disposed between the first movable duct wall and the support beam for acting against the pressure of the suspension acting upon the first duct wall;

the beam unit having opposite axial ends across the machine width;

the lifting appliance engaging the beam unit at the opposite axial ends of the beam unit via engaging means which connect the beam unit and the lifting appliance; and a flexible connection interconnecting the first movable duct wall and the support beam being defined at each axial end region of the movable duct wall;

wherein at each end of the first movable duct wall, the engaging means connects the lifting appliance directly to the movable duct wall beam, and the lifting appliance being structured and arranged to have a working line of its bearing force that passes substantially through the axial end of the cross-machine duct width for avoiding a bending moment on the movable duct wall, for transmitting the bearing force of the lifting appliance into the movable duct wall substantially free from bending moments.

2. The headbox of claim 1, wherein the first movable duct wall is supported to the headbox for pivoting movement of the first movable duct wall with respect to the second duct wall for adjusting the clear width of the outlet slot.

3. The headbox of claim 2, wherein the first movable duct wall has an upstream end portion away from the downstream end thereof and the first movable duct wall is pivoted to the headbox at the upstream end portion end thereof.

4. The headbox of claim 1, wherein the first and second walls of the outlet duct converge together in the flow direction of the suspension such that the clear width of the outlet slot narrows in the flow direction.

5. The headbox of claim 1, wherein the first movable duct wall is isothermal.

6. The headbox of claim 5, wherein the isothermal first movable duct wall includes temperature tempering ducts extending through the first duct wall for transmitting a flow of tempering fluid.

7. The headbox of claim 1, wherein the duct wall beam has a box-shaped cross-section.

8. The headbox of claim 7, wherein the pressure cushion is disposed between the duct wall beam and the support beam for acting on the duct wall beam in the same direction as the pressure of the suspension in the duct.

9. The headbox of claim 8, wherein the support beam of the beam unit is supported on the side of the duct wall beam away from the first movable duct wall; and further comprising a second beam, separate from the support beam, the second beam extending across the machine width and being located on the exterior of the support beam on the side thereof away from the duct wall beam;

a plurality of tension elements connecting the second beam to the duct wall beam independently of the support beam which is located between the second beam and the duct wall beam; and an additional pressure cushion disposed between the second beam and the support beam.

10. The headbox of claim 1, wherein the lifting appliance is pivoted to the headbox and pivoted to the first support beam.

11. The headbox of claim 1, wherein the flexible connection between the first movable duct wall and the support beam has a central axis which passes through the axial end of the duct width.

12. A headbox for a machine for the manufacture of fibrous webs from stock suspension, the headbox comprising:

means in the headbox for holding stock suspension; an outlet duct from the headbox, the outlet duct comprising first and second spaced apart duct walls oriented to extend across the width of the machine and across the direction of suspension flow to form, between the walls, an outlet slot from the headbox at the ends of the walls downstream in the direction of suspension flow; means defining a cross-machine width of the duct;

the first duct wall being supported to the headbox for being movable for varying the clear width between the walls of the outlet slot at the downstream ends of the walls through movement of the first duct wall toward and away from the second wall at the downstream ends of the walls;

a lifting appliance for moving the first duct wall for adjusting the clear width of the outlet slot, and the force of the lifting appliance acting against the pressure of the suspension acting on the first duct wall;

a support beam and a duct wall beam extending across the machine width and secured to the first movable duct wall for forming a beam unit;

a pressure cushion disposed between the first movable duct wall and the support beam for acting against the pressure of the suspension acting upon the first duct wall;

the beam unit having opposite axial ends across the machine width;

the lifting appliance engaging the beam unit at the opposite axial ends of the beam unit via engaging means which connect the beam unit and the lifting appliance; and a flexible connection interconnecting the first movable duct wall and the support beam being defined at each axial end region of the movable duct wall;

wherein at each axial end of the beam unit the engaging means connects the lifting appliance only to the support beam of the beam unit for avoiding a bending moment on the movable duct wall, for transmitting the bearing force of the lifting appliance into the movable duct wall substantially free from bending moments.

13. The headbox of claim 12, wherein the engaging means connects the lifting appliance to the support beam so as to apply the working line of the bearing force of the lifting appliance axially outward of the axial ends of the cross-machine duct width and the flexible connection avoids bending moments on the movable duct wall.

14. The headbox of claim 12, wherein the flexible connection between the first movable duct wall and the support beam has a central axis which passes through the axial end of the duct width.

15. The headbox of claim 12, wherein the axis of the lifting appliance is so disposed that the first movable duct wall is substantially free from torsional moments when the first movable duct wall is in its operational position and subjected to the pressure of stock suspension in the outlet duct.

16. The headbox of claim 13, wherein the axis of the lifting appliance is so disposed that the first movable duct wall is substantially free from torsional moments when the first movable duct wall is in its operational position and subjected to the pressure of stock suspension in the outlet duct, the axis of the lifting appliance passing substantially through the center of the first movable duct wall between the downstream end thereof and an upstream end thereof.

17. The headbox of claim 16, wherein the axis of the lifting appliance passes substantially along the central plane of the beam unit.

18. The headbox of claim 15, wherein the axis of the lifting appliance passes substantially along the central plane of the beam unit.

19. The headbox of claim 12, wherein the first movable duct wall is supported to the headbox for pivoting movement of the first movable duct wall with respect to the second duct wall for adjusting the clear width of the outlet slot.

20. The headbox of claim 19, wherein the first movable duct wall has an upstream end portion away from the downstream end thereof and the first movable duct wall is pivoted to the headbox at the upstream end portion end thereof.

21. The headbox of claim 12, wherein the first and second walls of the outlet duct converge together in the flow direction of the suspension such that the clear width of the outlet slot narrows in the flow direction.

22. The headbox of claim 12, wherein the first movable duct wall is isothermal.

23. The headbox of claim 22, wherein the isothermal first movable duct wall includes temperature tempering ducts extending through the first duct wall for transmitting a flow of tempering fluid.

24. The headbox of claim 12, wherein the duct wall beam has a box-shaped cross-section.

25. The headbox of claim 24, wherein the pressure cushion is disposed between the duct wall beam and the support beam for acting on the duct wall beam in the same direction as the pressure of the suspension in the duct.

26. The headbox of claim 25, wherein the support beam of the beam unit is supported on the side of the duct wall beam away from the first movable duct wall; and further comprising a second beam, separate from the support beam, the second beam extending across the machine width and being located on the exterior of the support beam on the side thereof away from the duct wall beam;

a plurality of tension elements connecting the second beam to the duct wall beam independently of the support beam which is located between the second beam and the duct wall beam; and an additional pressure cushion disposed between the second beam and the support beam.

27. The headbox of claim 12, wherein the lifting appliance is pivoted to the headbox and pivoted to the first support beam.

* * * * *